US012114716B2

(12) United States Patent
Manella et al.

(10) Patent No.: US 12,114,716 B2
(45) Date of Patent: Oct. 15, 2024

(54) GLASSES MOUNTED FACE SHIELD

(71) Applicant: Sonoco Development, Inc., Hartsville, SC (US)

(72) Inventors: Robert Manella, Batavia, IL (US); Jack Fuechsl, Somonauk, IL (US); Brian Gaster, Hanover Park, IL (US); Karen Berard, Morris, IL (US); Mark Brasel, Batavia, IL (US)

(73) Assignee: Sonoco Development, Inc., Hartsville, SC (US)

( * ) Notice: Subject to any disclaimer, the term of this patent is extended or adjusted under 35 U.S.C. 154(b) by 937 days.

(21) Appl. No.: 17/105,084

(22) Filed: Nov. 25, 2020

(65) Prior Publication Data

US 2022/0061423 A1 Mar. 3, 2022

Related U.S. Application Data

(63) Continuation of application No. 29/748,661, filed on Aug. 31, 2020, now Pat. No. Des. 983,870.

(51) Int. Cl.
*A41D 13/00* (2006.01)
*A41D 13/11* (2006.01)

(52) U.S. Cl.
CPC ..... *A41D 13/1161* (2013.01); *A41D 13/1107* (2013.01); *A41D 2500/52* (2013.01)

(58) Field of Classification Search
CPC ..... A41D 13/1161; A41D 13/1107; A41D 2500/52
See application file for complete search history.

(56) References Cited

U.S. PATENT DOCUMENTS 1,582,162 A 4/1926 Burstyn
1,582,164 A * 4/1926 Burstyn ..... A41D 13/1184 2/9

(Continued)

FOREIGN PATENT DOCUMENTS

IN 346196-001-0001 8/2022
RU 00043257 2/1997

(Continued)

OTHER PUBLICATIONS

Snowfoller Plastic Protective Mask, product availability Apr. 17, 2020 [online], picture review Jul. 10, 2020 [online], [site visited Aug. 24, 2022]:URL:<https://www.amazon.com/gp/product/B0876W67JW/ref=sw_img_1smid=A1Z2LKQHUAHF49&psc=1> (Year: 2020).

(Continued)

*Primary Examiner* — Richale L Quinn
(74) *Attorney, Agent, or Firm* — von Briesen & Roper, s.c.

(57) ABSTRACT

A glasses mounted face shield for mounting on a nose bridge of a pair of eyeglasses may include a shield bib fabricated from a flexible, translucent material and having a lock slot cut into the shield bib proximate a bib top edge from a shield front surface to a shield rear surface. A glasses engagement portion with a lock finger may extend upward from the the bib top edge. The lock finger is inserted through the lock slot and engages the shield bib proximate the lock slot to retain the lock finger within the lock slot. The glasses engagement portion may be wrapped around the nose bridge of the eyeglasses and the lock finger inserted through the lock slot to hang the glasses mounted face shield from the eyeglasses and in front of a face of a person wearing the eyeglasses.

19 Claims, 3 Drawing Sheets

(56) References Cited

U.S. PATENT DOCUMENTS

| | | | | | |
|---|---|---|---|---|---|
| 1,810,027 | A | * | 6/1931 | Moran | G02C 5/045 24/17 AP |
| 1,962,818 | A | | 6/1934 | Hoffman | |
| 2,197,973 | A | | 4/1940 | Everett et al. | |
| 2,233,698 | A | * | 3/1941 | Girouard | G02C 11/00 D16/330 |
| 2,363,557 | A | * | 11/1944 | Schauweker | G02C 7/16 2/9 |
| 2,364,354 | A | * | 12/1944 | Felch | G02C 5/12 D16/330 |
| D139,947 | S | * | 1/1945 | Saponoff | D2/627 |
| D166,853 | S | * | 5/1952 | Felch | D29/108 |
| 2,758,506 | A | * | 8/1956 | McNeill | G02C 9/02 2/13 |
| 3,299,439 | A | * | 1/1967 | Bohner | G02C 7/16 351/158 |
| 3,991,753 | A | | 11/1976 | Viesca y Viesca | |
| 4,027,340 | A | * | 6/1977 | Hadtke | A41G 7/00 2/206 |
| 4,674,133 | A | * | 6/1987 | Oschner | A61F 13/126 2/9 |
| 4,821,340 | A | * | 4/1989 | Johnson | A61F 9/029 351/158 |
| 4,843,643 | A | | 7/1989 | Parissenti et al. | |
| 4,924,526 | A | * | 5/1990 | Parissenti | A61F 9/029 2/9 |
| D308,587 | S | * | 6/1990 | Lund | D16/330 |
| 4,944,039 | A | | 7/1990 | Dietrich | |
| D323,410 | S | | 1/1992 | Jacobson | |
| D323,570 | S | * | 1/1992 | Jacobson | D16/330 |
| 5,214,800 | A | * | 6/1993 | Braun | A42B 1/208 2/205 |
| 5,274,847 | A | * | 1/1994 | Lauttamus | G02C 11/00 2/9 |
| 5,416,923 | A | * | 5/1995 | Peugh | G02C 11/00 2/9 |
| 5,666,664 | A | * | 9/1997 | Hamilton | G02C 11/00 2/9 |
| 5,692,522 | A | | 12/1997 | Landis | |
| 5,717,992 | A | * | 2/1998 | Tilghman | G02C 5/12 2/9 |
| 6,192,554 | B1 | * | 2/2001 | Dumcum | B65D 63/1018 24/30.5 P |
| 6,776,485 | B2 | * | 8/2004 | Cole | G02C 11/00 351/158 |
| D592,358 | S | * | 5/2009 | Masliantchouk | D29/108 |
| 8,387,163 | B2 | * | 3/2013 | Beliveau | A41D 13/11 128/857 |
| 9,032,554 | B2 | * | 5/2015 | Lucier | A42B 1/0192 2/9 |
| 10,175,390 | B2 | | 1/2019 | Nishimura et al. | |
| 10,278,866 | B2 | | 5/2019 | Moore et al. | |
| 10,624,789 | B2 | | 4/2020 | Schempp | |
| 11,294,200 | B2 | * | 4/2022 | Fedorov | G02C 11/00 |
| 11,400,323 | B2 | * | 8/2022 | Bernstein | A62B 7/10 |
| D983,870 | S | * | 4/2023 | Manella | D16/330 |
| 2015/0268484 | A1 | * | 9/2015 | Grace, Jr. | G02C 11/02 351/52 |
| 2016/0353815 | A1 | | 12/2016 | Nabai | |
| 2017/0184880 | A1 | * | 6/2017 | Grace, Jr. | G02C 11/02 |
| 2021/0368886 | A1 | | 12/2021 | Swart et al. | |
| 2021/0401084 | A1 | * | 12/2021 | Lamoncha | A41D 13/1184 |
| 2022/0030974 | A1 | * | 2/2022 | Kane | G02C 11/00 |
| 2022/0061423 | A1 | * | 3/2022 | Manella | A41D 13/1107 |
| 2022/0087333 | A1 | * | 3/2022 | Craigwell | A41D 13/1161 |

FOREIGN PATENT DOCUMENTS

| | | |
|---|---|---|
| WO | 8910106 | 2/1989 |
| WO | 9009209 | 8/1990 |

OTHER PUBLICATIONS

Face Sheild , product availability Aug. 29, 2019 [online], no video/picture review [online], [site visited Aug. 24, 2022]:URL:<https://www.ebay.com/itm/FACE-SHIELD-MAMMOGRAPHY-LORAD-HOLOGIC-M-IV-/283214102924?_ul-IN> (Year: 2019).

International Search Report & Written Opinion related to Application No. PCT/US2021/048494; reported Dec. 17, 2021.

* cited by examiner

GLASSES MOUNTED FACE SHIELD

CROSS-REFERENCE TO RELATED APPLICATION

This application is a continuation of U.S. patent application Ser. No. 29/748,661, filed Aug. 31, 2020, which is incorporated by reference herein in its entirety.

TECHNICAL FIELD

The present disclosure relates generally to face shields and, more particularly, to a glasses mounted face shield providing a barrier between a person wearing the face shield and a surrounding environment and being transparent to reveal facial features and lip movement to improve communication.

BACKGROUND

The current pandemic has made face coverings prevalent beyond healthcare workers to the public in general. Cloth masks are common for most people, while larger face shields are used by some people where more protective barriers are necessary. Despite being mostly effective in preventing the spread of germs and viruses, the various types of protective face coverings can have drawbacks. For example, large face shields that cover the entire face may distort the vision of the person wearing the shield. Cloth masks may be hot and uncomfortable, and they cover the mouth of the person wearing the mask and muffle their voice and thereby impede communication. Thus, there is a need for face coverings that are comfortable and do not negatively impact the ability of the person wearing the face covering to communicate while effectively preventing the spread of germs and viruses.

SUMMARY OF THE DISCLOSURE

In one aspect of the present disclosure, a glasses mounted face shield for mounting on a nose bridge of a pair of eyeglasses is disclosed. The glasses mounted face shield may include a shield bib fabricated from a flexible, translucent material and having a bib bottom edge, a bib top edge, a shield front surface and a shield rear surface, wherein a lock slot is cut into the shield bib proximate the bib top edge and from the shield front surface to the shield rear surface, a glasses engagement portion extending upward from the bib top edge, and a lock finger extending upward from the glasses engagement portion opposite the bib top edge. The lock finger may engage the shield bib proximate the lock slot after the lock finger is inserted through the lock slot to retain the lock finger within the lock slot, and the glasses engagement portion may be wrapped around the nose bridge of the pair of eyeglasses and the lock finger may be inserted through the lock slot to hang the glasses mounted face shield from the pair of eyeglasses and in front of a face of a person wearing the pair of eyeglasses.

In another aspect of the present disclosure, a glasses mounted face shield for mounting to a nose bridge of a pair of eyeglasses is disclosed. The glasses mounted face shield may include a shield bib fabricated from a flexible, translucent material and having a bib bottom edge, a bib top edge, a shield front surface and a shield rear surface, wherein a lock slot is cut into the shield bib proximate the bib top edge and from the shield front surface to the shield rear surface, a lock tongue extending from the bib top edge, a lock flap extending from the lock tongue opposite the bib top edge, wherein a lock flap width of the lock flap is less than a lock tongue width of the lock tongue, and a lock finger extending upward from the lock flap opposite the lock tongue. The lock finger may engage the shield bib proximate the lock slot after the lock finger is inserted through the lock slot to retain the lock finger within the lock slot, wherein the lock tongue and the lock flap may be wrapped around the nose bridge of the pair of eyeglasses with the lock tongue in front of the nose bridge, the lock flap behind the nose bridge and the lock finger inserted through the lock slot though the shield rear surface to hang the glasses mounted face shield from the pair of eyeglasses and in front of a face of a person wearing the pair of eyeglasses.

In a further aspect of the present disclosure, a glasses mounted face shield for mounting to a nose bridge of a pair of eyeglasses is disclosed. The glasses mounted face shield may include a shield bib fabricated from a flexible, translucent material and having a bib bottom edge, a bib top edge, a shield front surface and a shield rear surface, wherein the shield bib has a trapezoidal shape with a bib bottom edge width being greater than a bib top edge width, and wherein a lock slot is cut into the shield bib proximate the bib top edge and from the shield front surface to the shield rear surface. The glasses mounted face shield may further include a lock tongue extending from the bib top edge, a lock flap extending from the lock tongue opposite the bib top edge, wherein a lock flap width of the lock flap is less than a lock tongue width of the lock tongue, and wherein the lock flap comprises a pair of flap wings extending outward from opposite sides of the lock flap remote from the lock tongue, and a lock finger extending upward from the lock flap opposite the lock tongue. The lock finger may engage the shield bib proximate the lock slot after the lock finger is inserted through the lock slot to retain the lock finger within the lock slot, the lock tongue and the lock flap may be wrapped around the nose bridge of the pair of eyeglasses with the lock tongue in front of the nose bridge, the lock flap behind the nose bridge and the lock finger inserted through the lock slot though the shield rear surface to hang the glasses mounted face shield from the pair of eyeglasses and in front of a face of a person wearing the pair of eyeglasses. The pair of flap wings may be forced between a pair of lenses of the pair of eyeglasses and each flap wing may engage a lens front surface of a corresponding one of the pair of lenses.

Additional aspects are defined by the claims of this patent.

DETAILED DESCRIPTION

Figure 1:
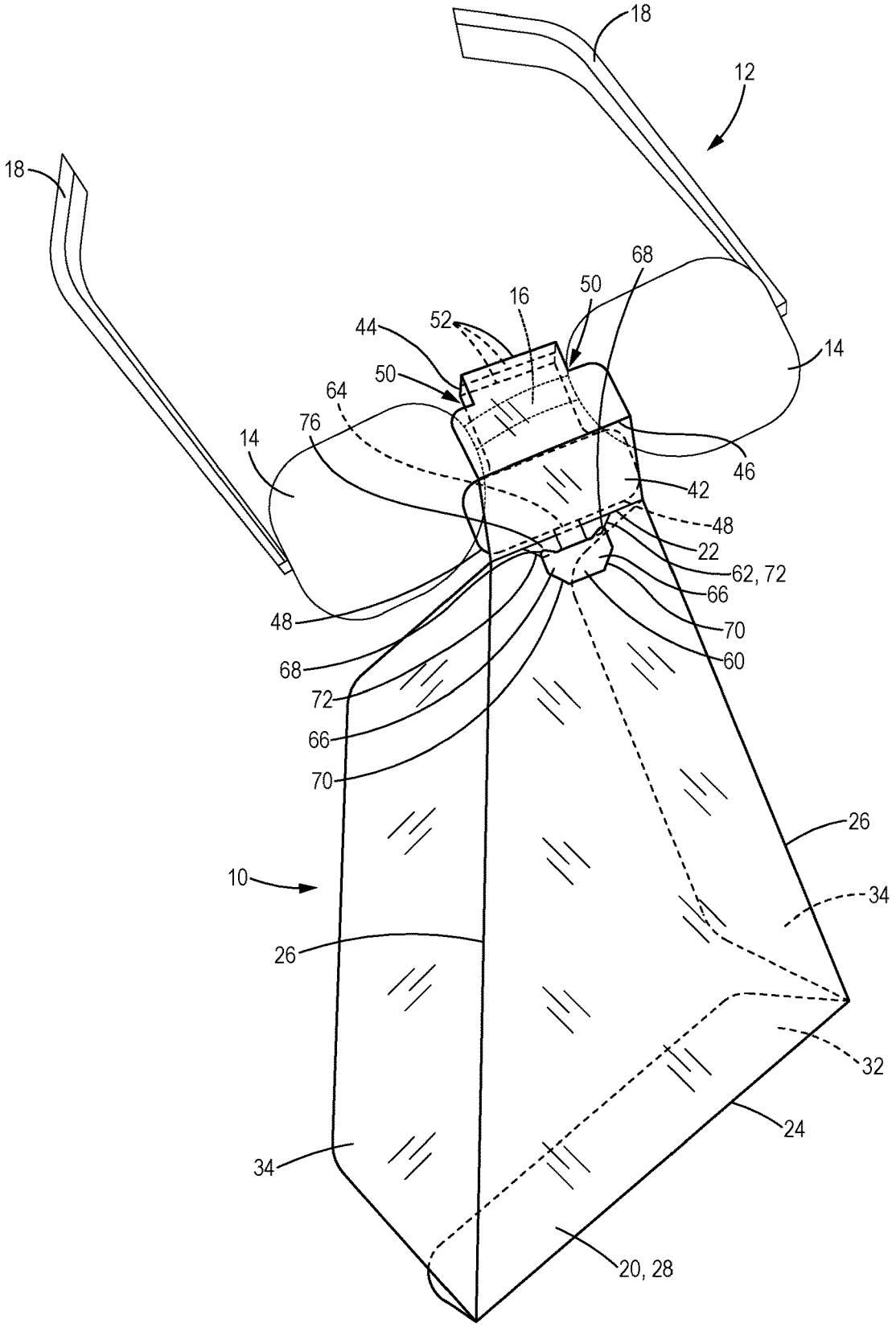
FIG. 1 is an isometric view of a pair of eyeglasses having a glasses mounted face shield in accordance with the present disclosure attached thereto.
Figure 3:
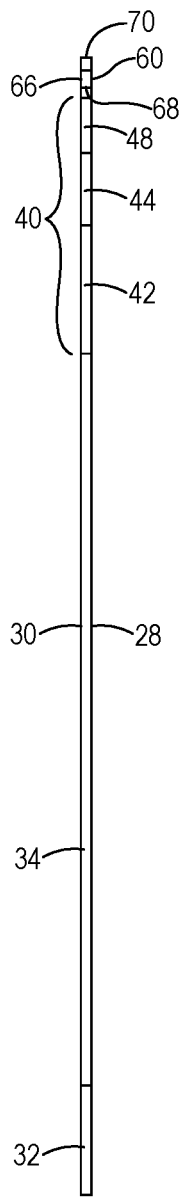
FIG. 3 is a side view of the glasses mounted face shield of FIG. 1 in a flattened position.

FIG. 1 illustrates an exemplary glasses mounted face shield 10 that is attachable to a pair of eyeglasses 12. The eyeglasses 12 may be a standard pair of reading glasses, safety glasses, sunglasses and the like having a pair of lenses 14 separated by a nose bridge 16. The lenses 14 may include nose pads (not shown) extending from inner edges proximate the nose bridge 16 that will rest on opposite sides of the nose of a person wearing the eyeglasses 12. Arms 18 extend rearward from the sides of the lenses 14 opposite the nose bridge 16 and will partially wrap around the ears of the person wearing the eyeglasses 12.

Figure 2:
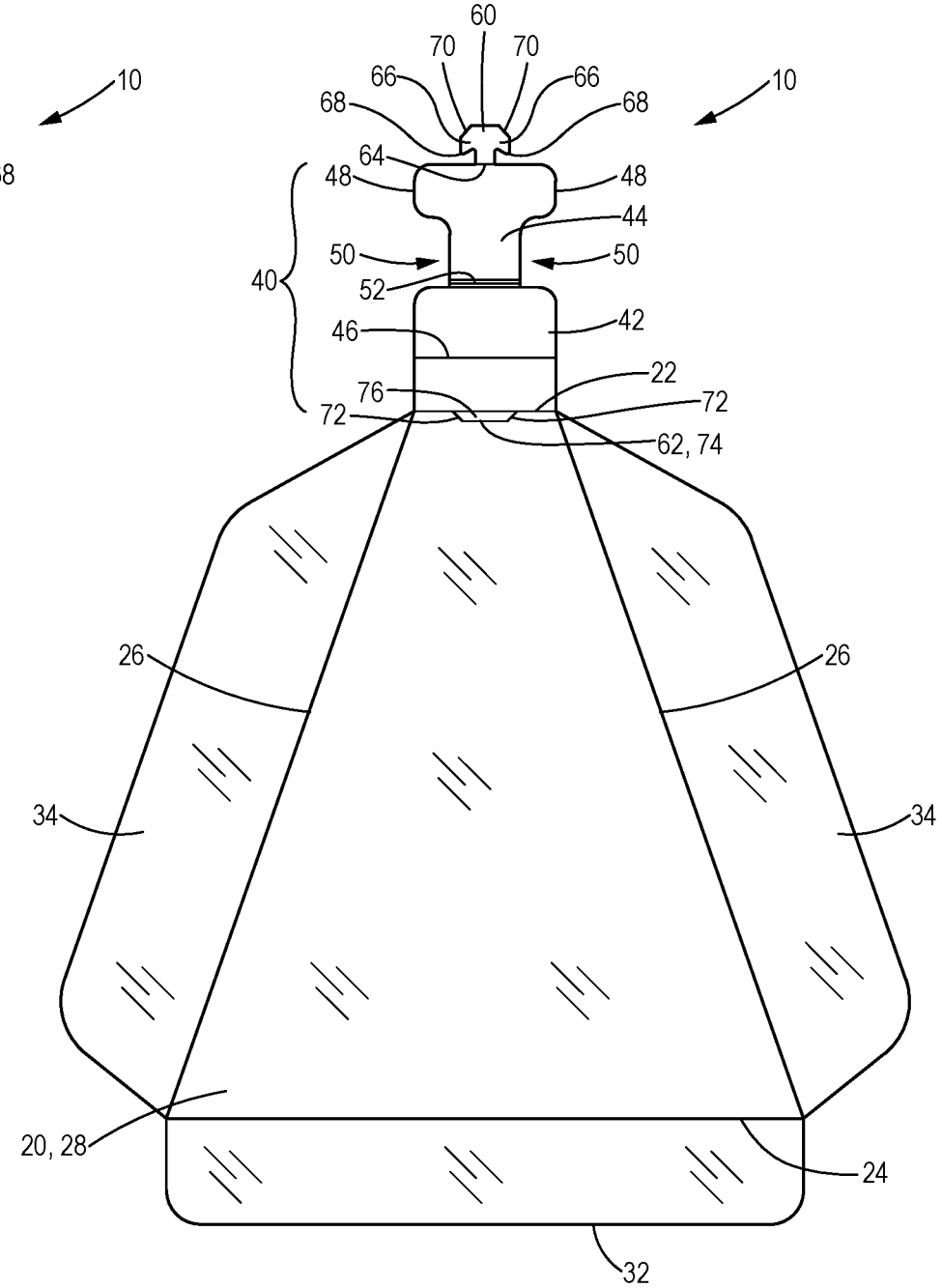
FIG. 2 is a front view of the glasses mounted face shield of FIG. 1 in a flattened position.

The face shield 10 may be attached at the nose bridge 16 of the eyeglasses 12 as shown in FIG. 1 and described hereinafter. FIG. 2 illustrates the face shield 10 prior to attachment to the eyeglasses 12. The face shield 10 may be formed from a transparent flexible material such as polyethylene terephthalate (PET) or another polymer material that may or may not be recyclable. The face shield 10 may be formed with the illustrated geometry, or may be cut from a sheet of the transparent material, such as by laser cutting, die cutting, stamping or the like. A shield bib 20 may comprise a bulk of the face shield 10. The shield bib 20 may have any size and shape that will provide protective covering of a face of the person wearing the face shield 10 and others around the person. In the illustrated embodiment, the shield bib 20 has a trapezoidal shape with a bib top edge 22 and a bib bottom edge 24 at opposite ends, and oppositely disposed bib side edges 26 extending between the bib top edge 22 and the bib bottom edge 24 on opposite sides of the shield bib 20. A bib bottom edge width may be greater than a bib top edge width to form the trapezoidal shape. The shield bib 20 in particular, and the face shield 10 in general, may have a shield front surface 28 that will face away from the person wearing the face shield 10, and a shield rear surface 30 that will face toward the person wearing the face shield 10 when the face shield 10 is attached to the eyeglasses 12 and the eyeglasses 12 are worn by the person.

The shield bib 20 may include additional structures to surround and isolate the face of the person wearing the face shield 10. As shown in FIGS. 1 and 2, the shield bib 20 may include a bib bottom flap 32 extending downward from the bib bottom edge 24. The bib bottom edge 24 may form a bib bottom crease so that the bib bottom flap 32 can fold rearward toward the shield rear surface 30 and toward the chin of the person wearing the face shield 10. The shield bib 20 may also include a bib side flap 34 extending outward from each of the bib side edges 26. The bib side edges 26 may form bib side creases so that the bib side flaps 34 can fold rearward toward the shield rear surface 30 and toward the corresponding cheeks of the person wearing the face shield 10.

A glasses engagement portion 40 of the face shield 10 extending from the bib top edge 22 functions to attach the face shield 10 to the eyeglasses 12. The glasses engagement portion 40 may include a lock tongue 42 extending upward from the bib top edge 22, and a lock flap 44 extending upward from the lock tongue 42 opposite the bib top edge 22. The lock tongue 42 may have a lock tongue width that is approximately equal to the bib top edge width, and may be greater than a lock flap width of the lock flap 44. A bib top crease may be formed at the bib top edge 22 so that the lock tongue 42 can fold rearward toward the shield rear surface 30 and the nose bridge 16 of the eyeglasses 12. An intermediate tongue crease 46 may be formed in the lock tongue 42 at a position between the bib top edge 22 and the lock flap 44. The intermediate tongue crease 46 may be parallel to the bib top edge 22 and further bend an upper portion of the lock tongue 42 and the lock flap 44 toward the nose bridge 16.

The lock flap 44 may be shaped to engage with the lenses 14 and the nose bridge 16 to hold the face shield 10 in place on the eyeglasses 12. The lock flap 44 may have a pair of flap wings 48 extending outward from opposite sides of the lock flap 44 and opposite the lock tongue 42. The flap wings 48 and corresponding portions of the lock tongue 42 may define cutout areas 50 therebetween that may receive corresponding edges of the lenses 14 when the face shield 10 is attached to the eyeglasses 12 as discussed further below. The lock flap 44 may further include one or more lock flap creases 52 formed therein proximate the intersection with the lock tongue 42. The flap crease(s) 52 may be parallel to the bib top edge 22 and the intermediate tongue crease 46 and may allow the lock flap 44 to bend further toward the shield rear surface 30 and to wrap around the nose bridge 16 as shown in FIG. 1.

Securement of the glasses engagement portion 40 around the nose bridge 16 may be provided by a lock finger 60 and a corresponding lock slot 62. The lock finger 60 may extend upward from the lock flap 44 opposite the lock tongue 42. If necessary, a lock finger crease 64 may be formed at the intersection of the lock flap 44 and the lock finger 60. The lock finger 60 may have a pair of lock tabs 66 extending outward from opposite sides of the lock finger 60 from an end opposite the lock flap 44. The lock tabs 66 may extend toward the lock flap 44 as they extend outward from the lock finger 60 and terminate at lock tips 68. Lock finger insertion surfaces 70 opposite the lock tips 68 may also extend toward the lock flap 44 as the lock tabs 66 extend away from the lock finger 60.

The lock slot 62 may be cut through the shield bib 20 proximate the bib top edge 22. The lock slot 62 may have a lock slot width that is greater than a lock finger width between outer edges of the lock tabs 66. The lock slot 62 may be parallel to the bib top edge 22 and the creases 46, 52, 64 of the glasses engagement portion 40. In the illustrated embodiment, the lock slot 62 is offset downward from the bib top edge 22, and includes slot diagonal cuts 72 extending from opposite ends of a slot horizontal cut 74 of the lock slot 62 to the bib top edge 22, thereby defining a lock slot lip 76. With this configuration, the lock slot lip 76 may be free to rotate outward away from the shield front surface 28 when the lock tongue 42 rotates rearward about the bib top crease and the bib top edge 22 to open the lock slot 62 for insertion of the lock finger 60 through the shield rear surface 30 as discussed further below. In alternate embodiments, the lock slot 62 may include only the slot horizontal cut 74 having a width greater than the lock finger width and located at or proximate to the bib top edge 22.

INDUSTRIAL APPLICABILITY

Figure 4:
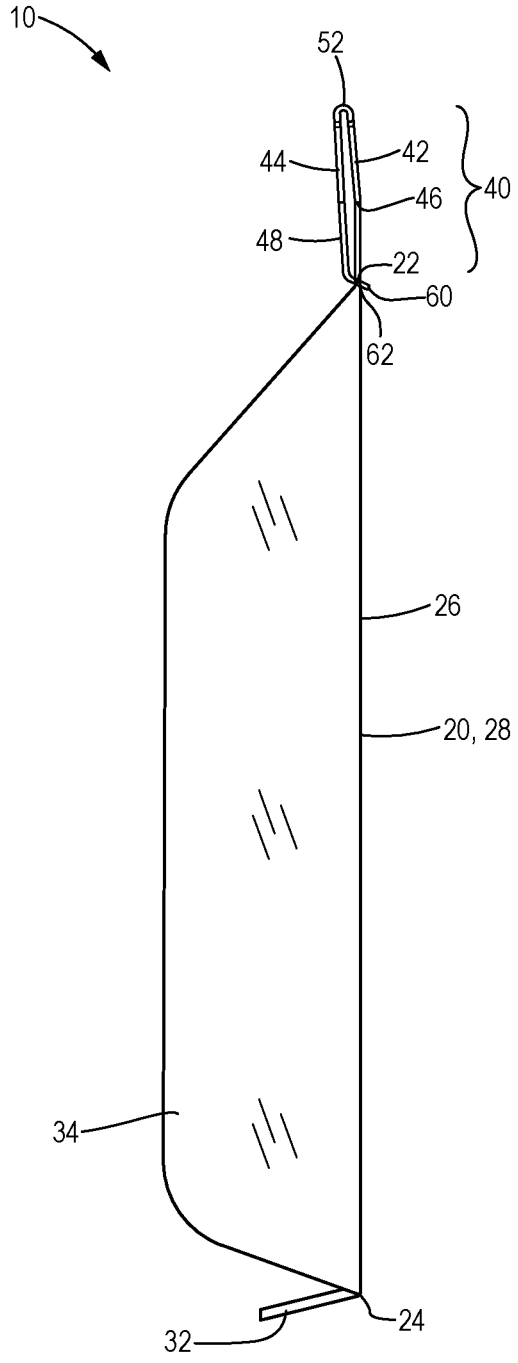
FIG. 4 is a side view of the glasses mounted face shield of FIG. 1 with bottom and side flaps folded rearward and a glasses engagement portion folded to an attachment position.

Referring to FIGS. 1 and 4, attachment of the face shield 10 to the eyeglasses 12 is shown. The face shield 10 is placed in front of the eyeglasses 12 with the shield rear surface 30 facing the eyeglasses 12 and the glasses engagement portion 40 proximate the nose bridge 16. Once in place, the lock flap 44 may be folded rearward about the lock flap creases 52 and to a position behind the nose bridge 16 so that the glasses engagement portion 40 surrounds the nose bridge 16. If necessary, the lock tongue 42 may be partially folded about the intermediate tongue crease 46. To further secure the position of the face shield 10 and displace the lock flap 44 forward to provide space for the nose of the person wearing the eyeglasses 12 between the lenses 14, the flap wings 48 may be pulled forward past the corresponding lenses 14 until the flap wings 48 face and engage the front surfaces of the lenses 14 and the inside edges of the lenses 14 are disposed within the cutout areas 50.

Permanent securement of the glasses engagement portion 40 around the nose bridge 16 is provided by inserting the lock finger 60 through the lock slot 62. The lower portion of the lock tongue 42 may be folded about the bib top crease to cause the lock slot lip 76 to rotate forward and open the lock slot 62. With the lock slot 62 open, the lock finger insertion surfaces 70 of the lock finger 60 may be inserted from the shield rear surface 30 through the lock slot 62 until the lock finger 60 extends out of the shield front surface 28 and the lock tips 68 of the lock tabs 66 are past the lock slot lip 76. The lock tips 68 may then be pulled or otherwise disposed in front of the lock slot lip 76 to hook the lock slot lip 76 and prevent the lock finger 60 from being pulled rearward through lock slot 62 by forces expected to be experienced by the face shield 10 during normal use. To remove the face shield 10 from the eyeglasses 12, the lock tips 68 may be unhooked from the lock slot lip 76 so the lock finger 60 can slide out of the lock slot 62.

The glasses mounted face shield 10 in accordance with the present disclosure may provide a light weight reusable face covering providing a protective barrier between the person wearing the eyeglasses 12 and those around them. In contrast to large face shields that cover the entire face including the eyes of the person wearing the face shield, the glasses mounted face shield 10 provides protection without covering the eyes so that the vision of the person wearing the face shield 10 is not distorted. Moreover, the face shield 10 comfortably hangs in front of the person's face, and covers the mouth of the person wearing the mask without muffling their voice and impeding communications as can happen with cloth face masks. Because the face shield 10 is fabricated from a transparent material, the mouth of the person wearing the face shield 10 is visible, which may be helpful when working with hearing impaired patients, for example.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A glasses mounted face shield for mounting on a nose bridge of a pair of eyeglasses, the glasses mounted face shield comprising:

a shield bib fabricated from a flexible, translucent material and having a bib bottom edge, a bib top edge, a shield front surface and a shield rear surface, wherein a lock slot is cut into the shield bib proximate the bib top edge and from the shield front surface to the shield rear surface;

a glasses engagement portion extending upward from the bib top edge, wherein the glasses engagement portion comprises:

a lock tongue extending from the bib top edge, and a lock flap extending from the lock tongue opposite the bib top edge, wherein a lock tongue width of the lock tongue is greater than a lock flap width of the lock flap; and a lock finger extending upward from the glasses engagement portion opposite the bib top edge, wherein the lock finger extends from the lock flap opposite the lock tongue, wherein the lock finger engages the shield bib proximate the lock slot after the lock finger is inserted through the lock slot to retain the lock finger within the lock slot, wherein the glasses engagement portion is wrapped around the nose bridge of the pair of eyeglasses and the lock finger is inserted through the lock slot to hang the glasses mounted face shield from the pair of eyeglasses and in front of a face of a person wearing the pair of eyeglasses, wherein the shield bib is adapted to cover the nose and mouth of the person wearing the pair of eyeglasses.

2. The glasses mounted face shield of claim 1, wherein the shield bib has a trapezoidal shape with a bib bottom edge width being greater than a bib top edge width.

3. The glasses mounted face shield of claim 1, comprising a bib bottom flap extending downward from the bib bottom edge, wherein a bib bottom crease is formed in the glasses mounted face shield at the bib bottom edge to fold the bib bottom flap toward the face of the person wearing the pair of eyeglasses.

4. The glasses mounted face shield of claim 1, wherein the shield bib has a pair of bib side edges disposed on opposite sides of the shield bib and each extending from the bib bottom edge to the bib top edge, wherein the shield bib comprises, at each bib side edge, a bib side flap extending outward from the bib side edge, wherein a bib side crease is formed in the glasses mounted face shield at each of the pair of bib side edges to fold the bib side flap toward the face of the person wearing the pair of eyeglasses.

5. The glasses mounted face shield of claim 1, wherein the shield rear surface is facing the pair of eyeglasses with the glasses engagement portion in front of the nose bridge and wrapped around the nose bridge with the lock finger inserted through the lock slot through the shield rear surface and extending outward from the shield front surface.

6. The glasses mounted face shield of claim 5, wherein the glasses engagement portion comprises a pair of flap wings extending outward from opposite sides of the glasses engagement portion proximate the lock finger, wherein the pair of flap wings are forced between a pair of lenses of the pair of eyeglasses and each flap wing engages a lens front surface of a corresponding one of the pair of lenses.

7. The glasses mounted face shield of claim 1, wherein the lock finger comprises a pair of lock tabs extending outward from opposite sides of the lock finger and downward toward the glasses engagement portion, wherein the pair of lock tabs engage a surface of the shield bib proximate the lock slot when the lock finger is inserted through the lock slot to prevent the lock finger from being pulled out of the lock slot.

8. The glasses mounted face shield of claim 1, wherein the lock flap has a plurality of lock flap creases defined therein, wherein the plurality of lock flap creases are parallel to each other and are parallel to the bib top edge, and wherein the lock flap is folded around the plurality of lock flap creases toward the nose bridge of the pair of eyeglasses.

9. The glasses mounted face shield of claim 1, wherein the lock tongue has an intermediate tongue crease defined therein, wherein the intermediate tongue crease is parallel to the bib top edge, and wherein the intermediate tongue crease is disposed between the bib top edge and the lock flap.

10. A glasses mounted face shield for mounting to a nose bridge of a pair of eyeglasses, the glasses mounted face shield comprising:

a shield bib fabricated from a flexible, translucent material and having a bib bottom edge, a bib top edge, a shield front surface and a shield rear surface, wherein a lock slot is cut into the shield bib proximate the bib top edge and from the shield front surface to the shield rear surface;

a lock tongue extending from the bib top edge;

a lock flap extending from the lock tongue opposite the bib top edge, wherein a lock flap width of the lock flap is less than a lock tongue width of the lock tongue; and a lock finger extending upward from the lock flap opposite the lock tongue, wherein the lock finger engages the shield bib proximate the lock slot after the lock finger is inserted through the lock slot to retain the lock finger within the lock slot, and wherein the lock tongue and the lock flap are wrapped around the nose bridge of the pair of eyeglasses with the lock tongue in front of the nose bridge, the lock flap behind the nose bridge and the lock finger inserted through the lock slot though the shield rear surface to hang the glasses mounted face shield from the pair of eyeglasses and in front of a face of a person wearing the pair of eyeglasses.

11. The glasses mounted face shield of claim 10, comprising a bib bottom flap extending downward from the bib bottom edge, wherein a bib bottom crease is formed in the glasses mounted face shield at the bib bottom edge to fold the bib bottom flap toward the face of the person wearing the pair of eyeglasses.

12. The glasses mounted face shield of claim 10, wherein the shield bib has a pair of bib side edges disposed on opposite sides of the shield bib and each extending from the bib bottom edge to the bib top edge, wherein the shield bib comprises, at each bib side edge, a bib side flap extending outward from the bib side edge, wherein a bib side crease is formed in the glasses mounted face shield at each of the pair of bib side edges to fold the bib side flap toward the face of the person wearing the pair of eyeglasses.

13. The glasses mounted face shield of claim 10, wherein the lock flap comprises a pair of flap wings extending outward from opposite sides of the lock flap proximate the lock finger, wherein the pair of flap wings are forced between a pair of lenses of the pair of eyeglasses and each flap wing engages a lens front surface of a corresponding one of the pair of lenses.

14. The glasses mounted face shield of claim 10, wherein the lock finger comprises a pair of lock tabs extending outward from opposite sides of the lock finger and downward toward the lock flap, wherein the pair of lock tabs engage the shield front surface proximate the lock slot when the lock finger is inserted through the lock slot to prevent the lock finger from being pulled out of the lock slot.

15. The glasses mounted face shield of claim 10, wherein the lock flap has a plurality of lock flap creases defined therein, wherein the plurality of lock flap creases are parallel to each other and are parallel to the bib top edge, and wherein the lock flap is folded around the plurality of lock flap creases toward the nose bridge of the pair of eyeglasses.

16. A glasses mounted face shield for mounting to a nose bridge of a pair of eyeglasses, the glasses mounted face shield comprising:

a shield bib fabricated from a flexible, translucent material and having a bib bottom edge, a bib top edge, a shield front surface and a shield rear surface, wherein the shield bib has a trapezoidal shape with a bib bottom edge width being greater than a bib top edge width, and wherein a lock slot is cut into the shield bib proximate the bib top edge and from the shield front surface to the shield rear surface;

a lock tongue extending from the bib top edge;

a lock flap extending from the lock tongue opposite the bib top edge, wherein a lock flap width of the lock flap is less than a lock tongue width of the lock tongue, and wherein the lock flap comprises a pair of flap wings extending outward from opposite sides of the lock flap remote from the lock tongue; and a lock finger extending upward from the lock flap opposite the lock tongue, wherein the lock finger engages the shield bib proximate the lock slot after the lock finger is inserted through the lock slot to retain the lock finger within the lock slot, wherein the lock tongue and the lock flap are wrapped around the nose bridge of the pair of eyeglasses with the lock tongue in front of the nose bridge, the lock flap behind the nose bridge and the lock finger inserted through the lock slot though the shield rear surface to hang the glasses mounted face shield from the pair of eyeglasses and in front of a face of a person wearing the pair of eyeglasses, and wherein the pair of flap wings are forced between a pair of lenses of the pair of eyeglasses and each flap wing engages a lens front surface of a corresponding one of the pair of lenses.

17. The glasses mounted face shield of claim 16, comprising a bib bottom flap extending downward from the bib bottom edge, wherein a bib bottom crease is formed in the glasses mounted face shield at the bib bottom edge to fold the bib bottom flap toward the face of the person wearing the pair of eyeglasses.

18. The glasses mounted face shield of claim 16, wherein the shield bib has a pair of bib side edges disposed on opposite sides of the shield bib and each extending from the bib bottom edge to the bib top edge, wherein the shield bib comprises, at each bib side edge, a bib side flap extending outward from the bib side edge, wherein a bib side crease is formed in the glasses mounted face shield at each of the pair of bib side edges to fold the bib side flap toward the face of the person wearing the pair of eyeglasses.

19. The glasses mounted face shield of claim 16, wherein the lock flap has a plurality of lock flap creases defined therein, wherein the plurality of lock flap creases are parallel to each other and are parallel to the bib top edge, and wherein the lock flap is folded around the plurality of lock flap creases toward the nose bridge of the pair of eyeglasses.

* * * * *